US007159253B2

(12) United States Patent
Yang

(10) Patent No.: US 7,159,253 B2
(45) Date of Patent: Jan. 9, 2007

(54) MODULAR HEADBOARD AND METHOD OF ASSEMBLY

(75) Inventor: Tony Shuikuan Yang, Columbus, OH (US)

(73) Assignee: American Signature, Inc., Columbus, OH (US)

( * ) Notice: Subject to any disclaimer, the term of this patent is extended or adjusted under 35 U.S.C. 154(b) by 75 days.

(21) Appl. No.: 10/920,130

(22) Filed: Aug. 17, 2004

(65) Prior Publication Data

US 2006/0037135 A1 Feb. 23, 2006

(51) Int. Cl.
*A47C 17/00* (2006.01)

(52) U.S. Cl. ..... 5/53.1; 5/285

(58) Field of Classification Search ..... 5/280, 5/285, 279.1, 53.1, 430, 324, 425, 426
See application file for complete search history.

(56) References Cited

U.S. PATENT DOCUMENTS

| | | | | | |
|---|---|---|---|---|---|
| 29,066 | A | * | 7/1860 | Elder | 5/132 |
| 471,533 | A | | 3/1892 | Chambers | |
| 490,066 | A | | 1/1893 | Chambers | |
| 795,155 | A | * | 7/1905 | Nees | 340/545.6 |
| 1,466,599 | A | | 8/1923 | Purdon | |
| 1,474,237 | A | * | 11/1923 | Caldwell | 5/280 |
| 2,223,955 | A | | 12/1940 | Greenbaum | |
| 2,266,370 | A | | 12/1941 | Kratky | |
| 2,541,194 | A | | 2/1951 | Bornhuetter | |
| 2,671,910 | A | | 3/1954 | Wallen | |
| 2,687,537 | A | * | 8/1954 | Wallace et al. | 5/280 |
| 3,414,912 | A | * | 12/1968 | Dusey, Sr. et al. | 5/52 |
| 4,641,385 | A | * | 2/1987 | Peters et al. | 5/430 |
| 4,747,171 | A | * | 5/1988 | Einsele et al. | 5/425 |
| 5,038,427 | A | * | 8/1991 | Golden | 5/93.2 |
| 5,146,631 | A | | 9/1992 | Deal | |
| 5,173,974 | A | * | 12/1992 | Proano et al. | 5/93.2 |
| 5,269,032 | A | * | 12/1993 | Flocks | 5/285 |
| 6,128,857 | A | * | 10/2000 | Morgan et al. | 49/74.1 |
| 6,557,191 | B1 | | 5/2003 | Bellows et al. | |

* cited by examiner

*Primary Examiner*—Patricia Engle
*Assistant Examiner*—Jonathan Liu
(74) *Attorney, Agent, or Firm*—Wood, Herron & Evans, LLP

(57) ABSTRACT

A modular headboard for a bedstead includes an upper headboard section and a lower headboard section selectively coupled together for convenient storage and transportation. The upper headboard section includes laterally-spaced, vertically-extending upper post sections and a headboard panel extending therebetween. The lower headboard section includes corresponding lower post sections, with cross rails extending between the lower post sections. A laterally-extending slat overlaps adjacent edges of the upper and lower headboard sections to facilitate alignment of the upper and lower headboard sections, and is secured to the headboard sections to form a stable headboard.

12 Claims, 6 Drawing Sheets

MODULAR HEADBOARD AND METHOD OF ASSEMBLY

FIELD OF THE INVENTION

The present invention pertains generally to bedsteads, and more particularly to a modular headboard for a bedstead.

BACKGROUND OF THE INVENTION

Large, ornate bedsteads, particularly those for queen and king size beds, present difficulties for manufacturers, retailers and purchasers with respect to storing and transporting the large components that make up the bedsteads. In particular, large headboards cause storage and transportation problems for manufacturers and retailers due to their large size, and for purchasers who are faced with the problem of getting the bedstead from the store to their residence. Moreover, large bedsteads create problems for purchasers with respect to negotiating tight corners, doorways, and stairways of a residence.

One solution to the problems presented by large bedsteads has been to provide components of bedsteads in a modular configuration, including modular headboards that can be assembled and disassembled as desired.

One drawback of modular bedsteads, however, particularly those intended to support king and queen-size bedding, is that of providing a sturdy, robust bedstead that provides stable support to the bedding and occupants of the bed while not being overly complicated to assemble. A need therefore exists for an improved modular bedstead that addresses these and other drawbacks of the prior art.

SUMMARY OF THE INVENTION

The present invention provides a modular headboard and bedstead that can be quickly and easily assembled and disassembled and, when assembled, provides a sturdy base for supporting bedding thereon. Moreover, the modular headboard contributes to providing an aesthetically pleasing and staunch appearance to the bedstead. In one embodiment, the modular headboard includes an upper headboard section having first and second laterally-spaced, vertically-extending upper post sections and a headboard panel extending therebetween. The upper headboard section is removably connected to a lower headboard section, which includes corresponding first and second laterally-spaced, vertically-extending lower post sections and at least one cross member, and preferably upper and lower cross members in the form of cross rails, extending between the lower post sections. A connection system joining the upper and lower headboard section includes a laterally-extending slat coupled to and overlapping a lower edge of the headboard panel and an upper edge of the upper cross rail. The slat helps to locate and position the upper headboard section atop the lower headboard section during assembly and ensures a stable, secure connection between the upper and lower headboard sections. Moreover, the slat helps to provide the modular headboard with a staunch appearance.

In another embodiment, the connection system for the modular headboard further includes first and second brace plates fastened between the respective upper and lower ends of the upper and lower post sections. In yet another embodiment, apertures are formed in each of the lower ends of the upper post sections, and in each of the upper ends of the lower post sections, and dowel pins are installed in the apertures to extend between the upper and lower post sections to thereby increase the sturdiness of the modular headboard. In yet another embodiment, the modular headboard further includes a vertically-extending center post coupled to the upper and lower cross members of the lower headboard section. The center post includes a flange that extends from the upper end of the center post to overlie the laterally-extending slat.

In yet another embodiment, the modular headboard is joined to a footboard spaced from the headboard by first and second side rails to form a bedstead. First ends of the first and second side rails are coupled to the lower post sections of the modular headboard, and second ends of the side rails are coupled to the footboard.

In accordance with the present invention, a method of assembling a modular headboard having upper and lower headboard sections includes positioning the upper headboard section on top of the lower headboard section, aligning a lapped slat extending from a lower edge of the upper headboard section, to overlie the upper edge of the lower headboard section, and securing the lapped slat to the lower headboard section. In another embodiment, the method further includes installing dowel pins into apertures formed in one of the upper and lower headboard sections, aligning apertures on the other of the upper and lower headboard sections with the dowel pins, and engaging the apertures on the other of the upper and lower headboard sections with the dowel pins.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
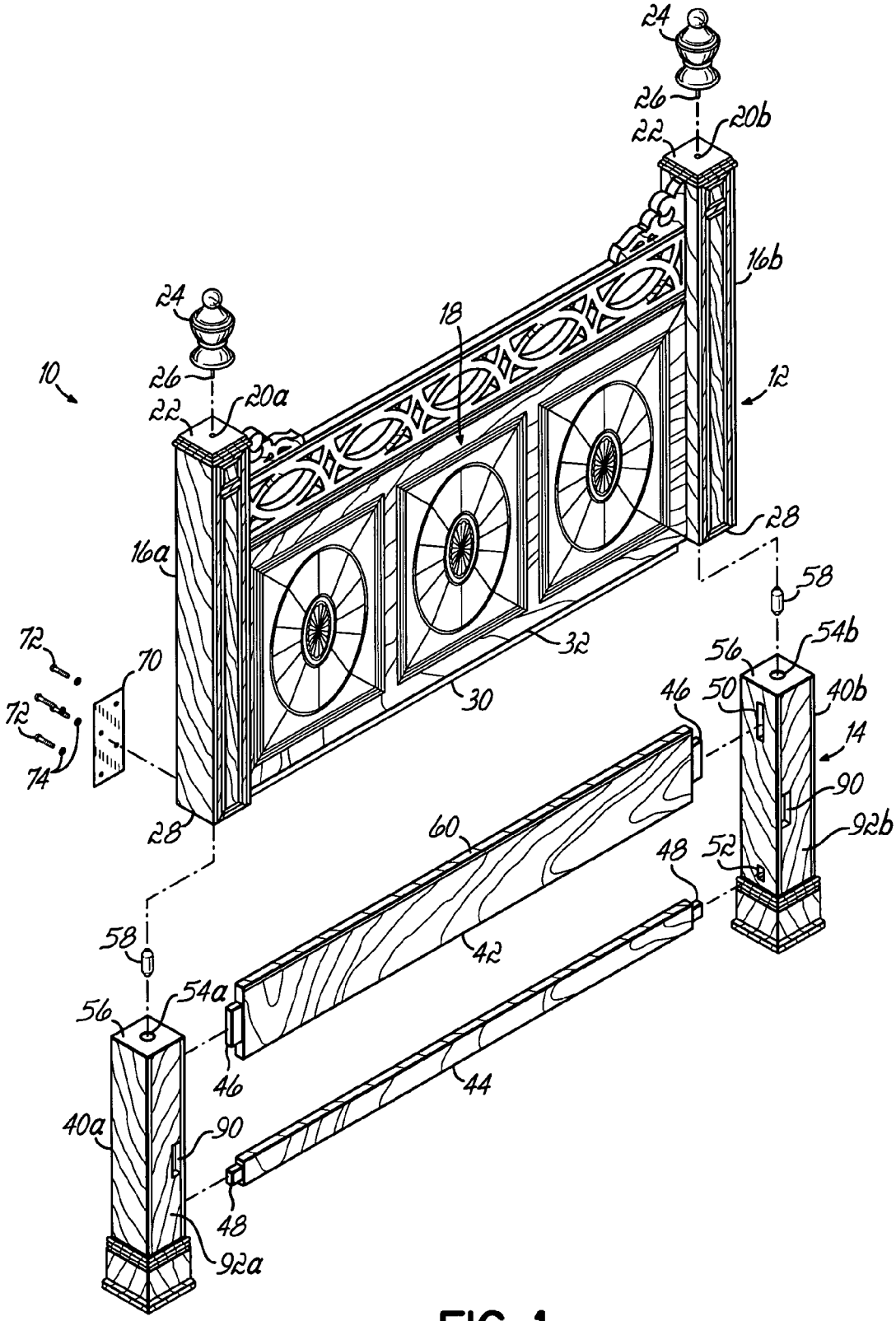
FIG. 1 is an exploded perspective view of an exemplary modular headboard, according to the present invention.

Referring now to FIGS. 1, 2, 5 and 7, there is shown an exemplary modular headboard 10 according to the present invention. The modular headboard 10 includes an upper headboard section 12 and a lower headboard section 14 that can be joined together to form a stable headboard for use with a bedstead. The upper headboard section 12 includes first and second laterally-spaced and vertically-extending upper post sections 16*a*, 16*b* and a headboard panel 18 extending therebetween. The headboard panel 18 and the upper post sections 16*a*, 16*b* may include various trim work or decorative designs to provide an aesthetically pleasing appearance to the headboard 10, as known in the art. Apertures 20*a*, 20*b* are formed in the upper ends 22 of the upper post sections 16*a*, 16*b* for receiving finials 24 or other decorative ornamentation that may be secured to the upper ends 22 of the upper post sections 16*a*, 16*b* by dowels 26 configured to be received in the apertures 20*a*, 20*b*. Corresponding apertures (not shown) are provided in the lower ends 28 of the upper post sections 16*a*, 16*b* to facilitate assembly of the modular headboard 10 and to improve the sturdiness of the assembled modular headboard 10, as will be described in more detail below.

Figure 5:
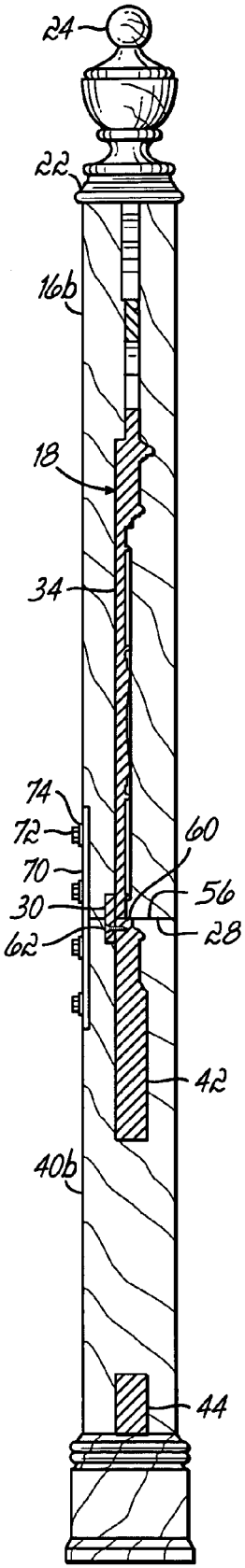
FIG. 5 is a cross-sectional view of the modular headboard of FIG. 2, taken along line 5—5.
Figure 7:
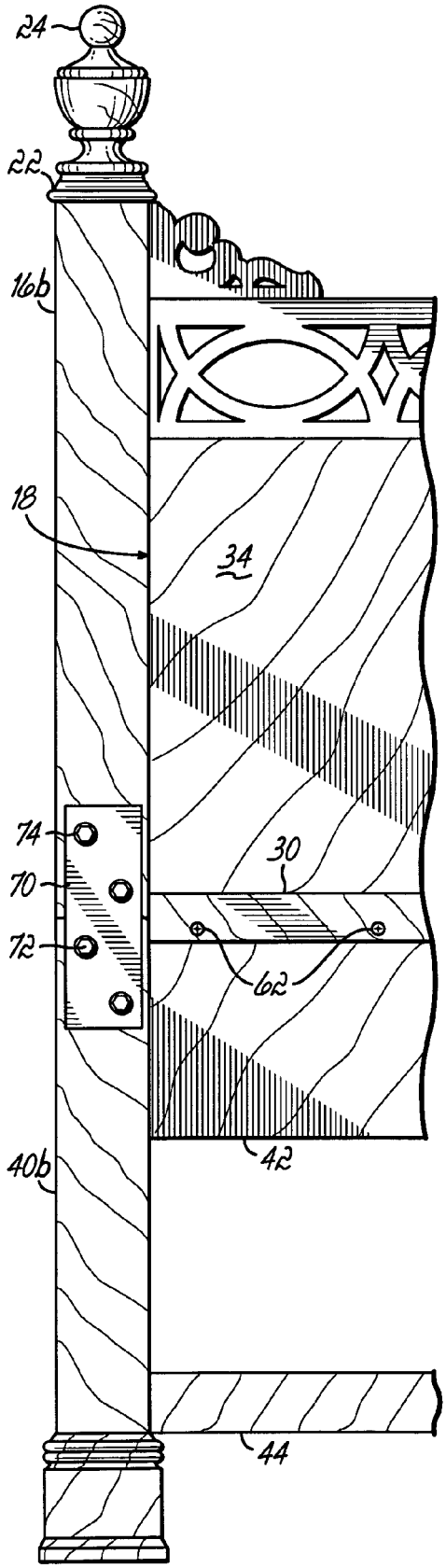
FIG. 7 is a partial rear view of a modular headboard of the present invention.

A laterally-extending slat 30 overlies the lower edge 32 of the headboard panel 18, on a rear side 34 thereof, and extends downwardly therefrom, as best depicted in FIGS. 5 and 7. The laterally-extending slat 30 may be secured to the headboard panel 18 in any suitable fashion, such as by adhesives, fasteners, or other mechanical connections formed therebetween.

With continued reference to FIGS. 1, 2, 5 and 7, the lower headboard section 14 includes first and second laterally-spaced and vertically-extending lower post sections 40*a*, 40*b* positioned for alignment with the upper post sections 16*a*, 16*b* of the upper headboard section 12. At least one cross member, and preferably upper and lower cross members in the form of cross rails 42, 44, extend laterally between the first and second lower post sections 40*a*, 40*b* and respective lateral ends of the upper and lower cross rails 42, 44 are joined to the respective first and second lower post sections 40*a*, 40*b*. In the exemplary embodiment shown, the upper and lower cross rails 42, 44 have tenons 46, 48 extending from their respective ends for connection to the lower post sections 40*a*, 40*b* through corresponding mortises 50, 52 formed therein. The tenons 46, 48 on the cross rails 42, 44 may be secured within the mortises 50, 52 of the lower post sections 40*a*, 40*b* by glue, fasteners, or other methods, as known in the art.

Apertures 54*a*, 54*b* are formed in the upper ends 56 of the lower post sections 40*a*, 40*b*, at locations aligned with corresponding apertures formed in the lower ends 28 of the upper post sections 16*a*, 16*b*, whereby dowels 58 may be inserted to extend between the upper and lower post sections 16*a*, 16*b*, 40*a*, 40*b* in the respectively aligned apertures when the upper headboard section 12 is positioned on top of the lower headboard section 14. Advantageously, the dowels 58 may be inserted first into either the upper or lower post sections 16*a*, 16*b*, 40*a*, 40*b*, then subsequently engaged with the other of the upper and loser post sections when the upper and lower headboard sections 12, 14 are joined. The dowels 58 have tapered ends to facilitate aligning the upper and lower headboard sections 12, 14 when the modular headboard 10 is being assembled.

As best depicted in FIGS. 5 and 7, the laterally-extending slat 30 depending from the lower edge 32 of the upper headboard section 12 overlaps the upper edge 60 of the upper cross rail 42 when the upper headboard section 12 and lower headboard section 14 are joined together. The laterally-extending slat 30 facilitates proper alignment of the upper headboard section 12 with the lower headboard section 14, whereafter the laterally-extending slat 30 may be secured to the upper cross rail 42, such as by fasteners 62, glue, or other mechanical interlock suitable for securing the upper and lower headboard sections 12, 14. While the slat 30 has been depicted in FIG. 1 as initially depending from the lower edge 32 of the headboard panel 18, it will be recognized that the slat 30 may alternatively extend upwardly from the upper edge 60 of the upper cross rail 42, whereafter the slat 30 may be secured to the lower edge 32 of the headboard panel 18, such as by fasteners 62, glue, or other suitable mechanical interlock, as depicted in FIGS. 5 and 7.

Figure 2:
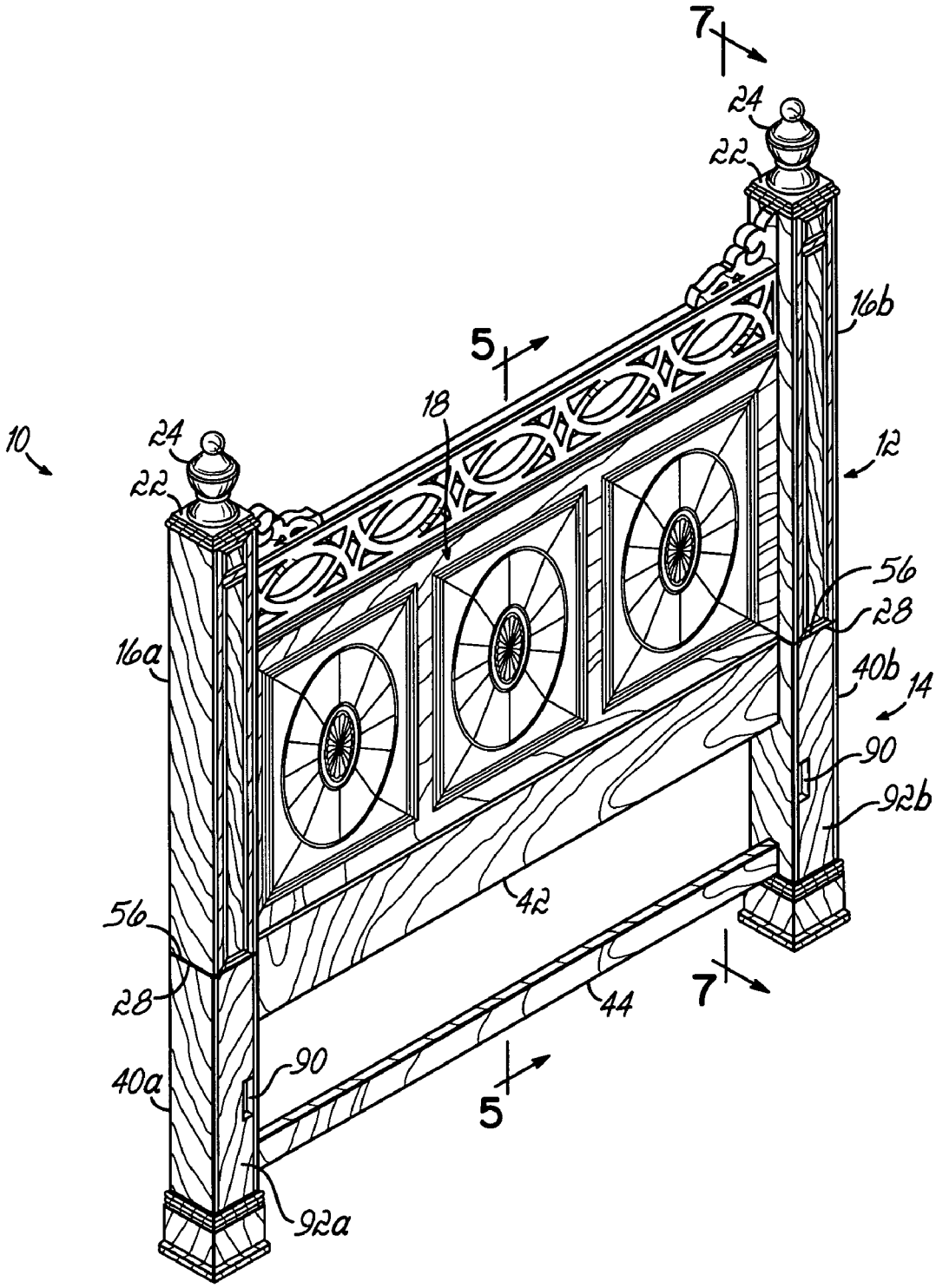
FIG. 2 is a perspective view of the modular headboard of FIG. 1, depicted in an assembled condition.

As best depicted in FIGS. 1, 5 and 7, the modular headboard 10 of the present invention further includes first and second brace plates 70, fastened between the upper ends 56 of the lower post sections 40*a*, 40*b* and the lower ends 28 of the upper post sections 16*a*, 16*b*, such as by bolts or wood screws 72 and washers 74, to further improve the sturdiness of the assembled modular headboard 10. The assembled headboard 10 of FIG. 1 is depicted in FIG. 2.

Figure 3:
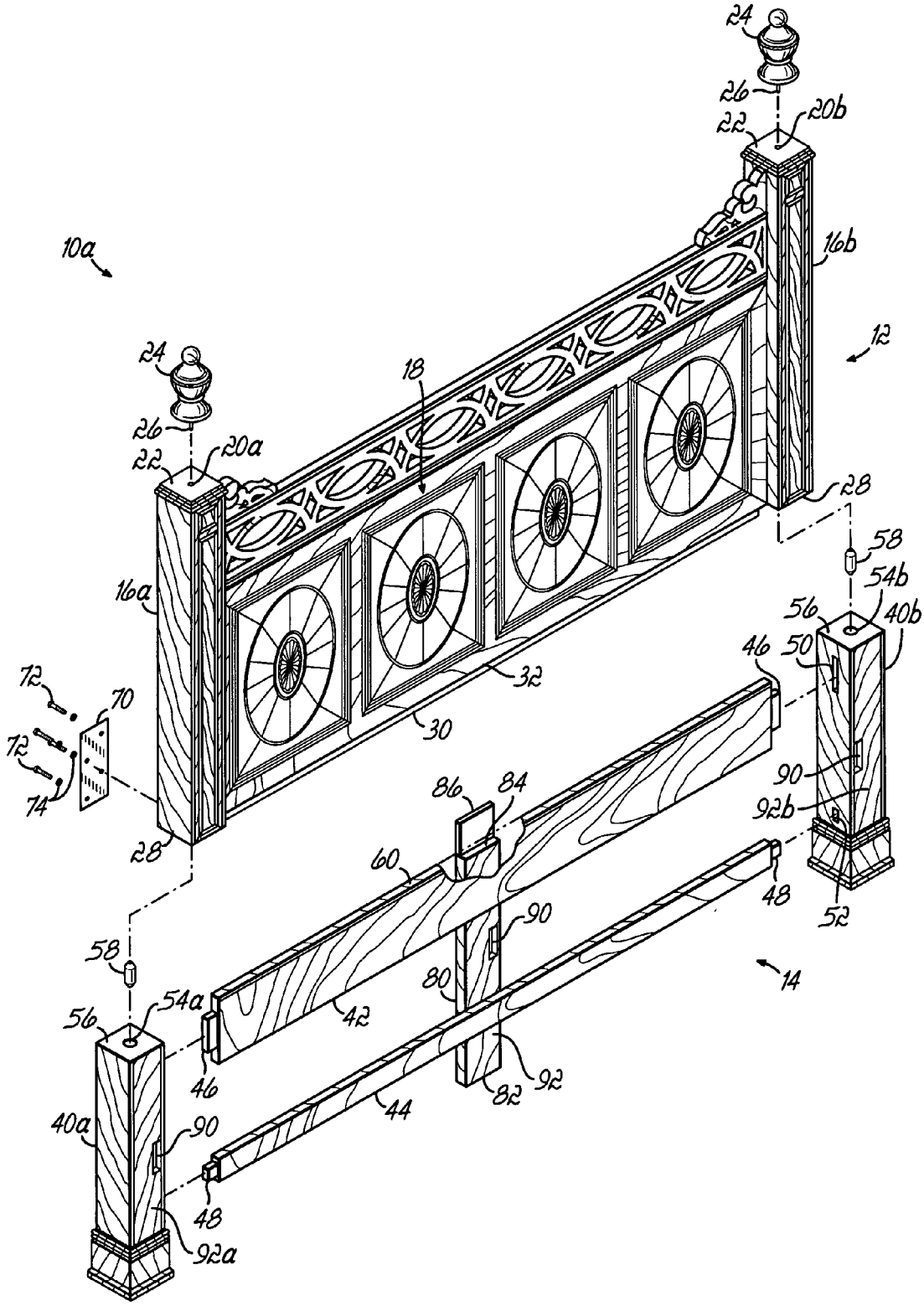
FIG. 3 is an exploded perspective view of another embodiment of a modular headboard, according to the present invention.
Figure 4:
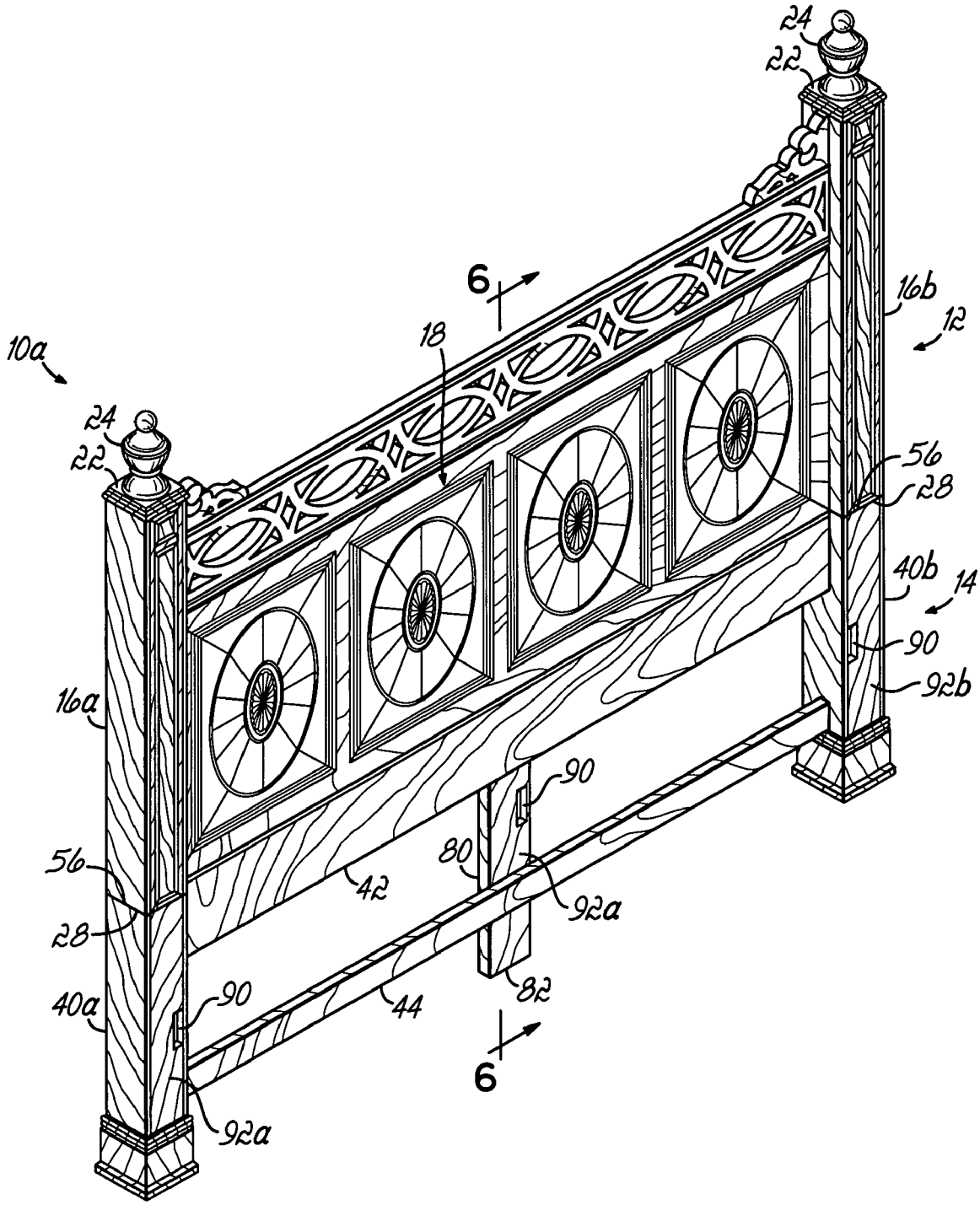
FIG. 4 is a perspective view of the modular headboard of FIG. 3, depicted in an assembled condition.
Figure 6:
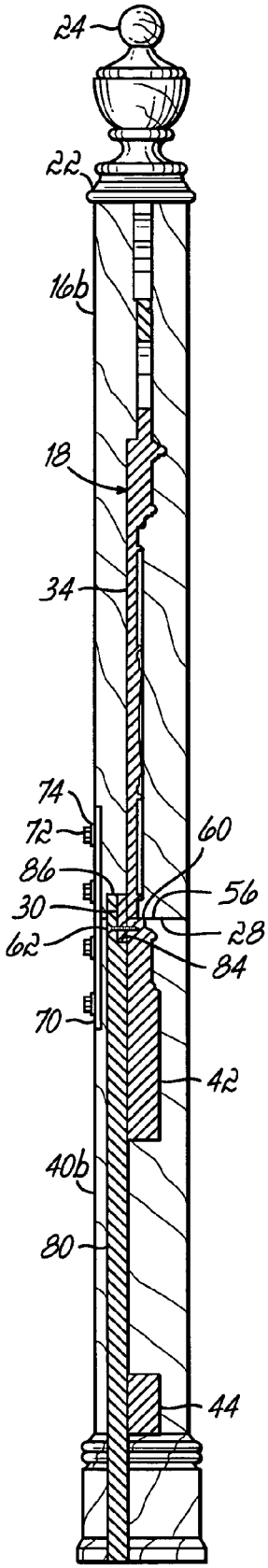
FIG. 6 is a cross-section view of the modular headboard of FIG. 4, taken along line 6—6.

Referring now to FIGS. 3, 4 and 6, another embodiment of a modular headboard 10*a* according to the present invention is shown. The modular headboard 10*a* of FIGS. 3, 4 and 6 is similar in all respects to the modular headboard 10 of FIGS. 1, 2 and 5, but further includes a center post 80 coupled to the upper and lower cross members 42, 44 and to the laterally-extending slat 30. Accordingly, like features of the headboard 10*a* of FIGS. 3, 4 and 6 have been similarly numbered. Specifically, the modular headboard 10*a* includes upper and lower headboard sections 12, 14 that may be quickly and easily assembled together to form a sturdy headboard for a bedstead. The vertically-extending center post 80 has a lower end 82 that contacts a floor surface and an upper end 84 that extends toward the upper edge 60 of the upper cross rail 42. The upper end 84 of the center post 80 does not extend completely to the top edge 60 of the upper cross rail 42, but is recessed a distance sufficient to accommodate the slat 30.

The center post 80 further includes a flange 86 extending upwardly from the upper end 84 of the center post 80 such that the flange 86 overlies the slat 30 on the upper headboard section 12 when the upper and lower headboard sections 12, 14 are joined together, as best depicted in FIG. 6. Advantageously, the center post 80, slat 30 and upper cross rail 42 may be joined together, for example, by threaded fasteners 62 installed through the components, as depicted in FIG. 6. Alternatively, it will be recognized that the center post 80, slat 30 and upper cross rail 42 may be secured by other methods. The center post 80 provides additional sturdiness and stability to the modular headboard 10*a* and may be particularly desirable for use with king size bedding. The assembled modular headboard 10*a* is depicted in FIG. 4.

Figure 8:
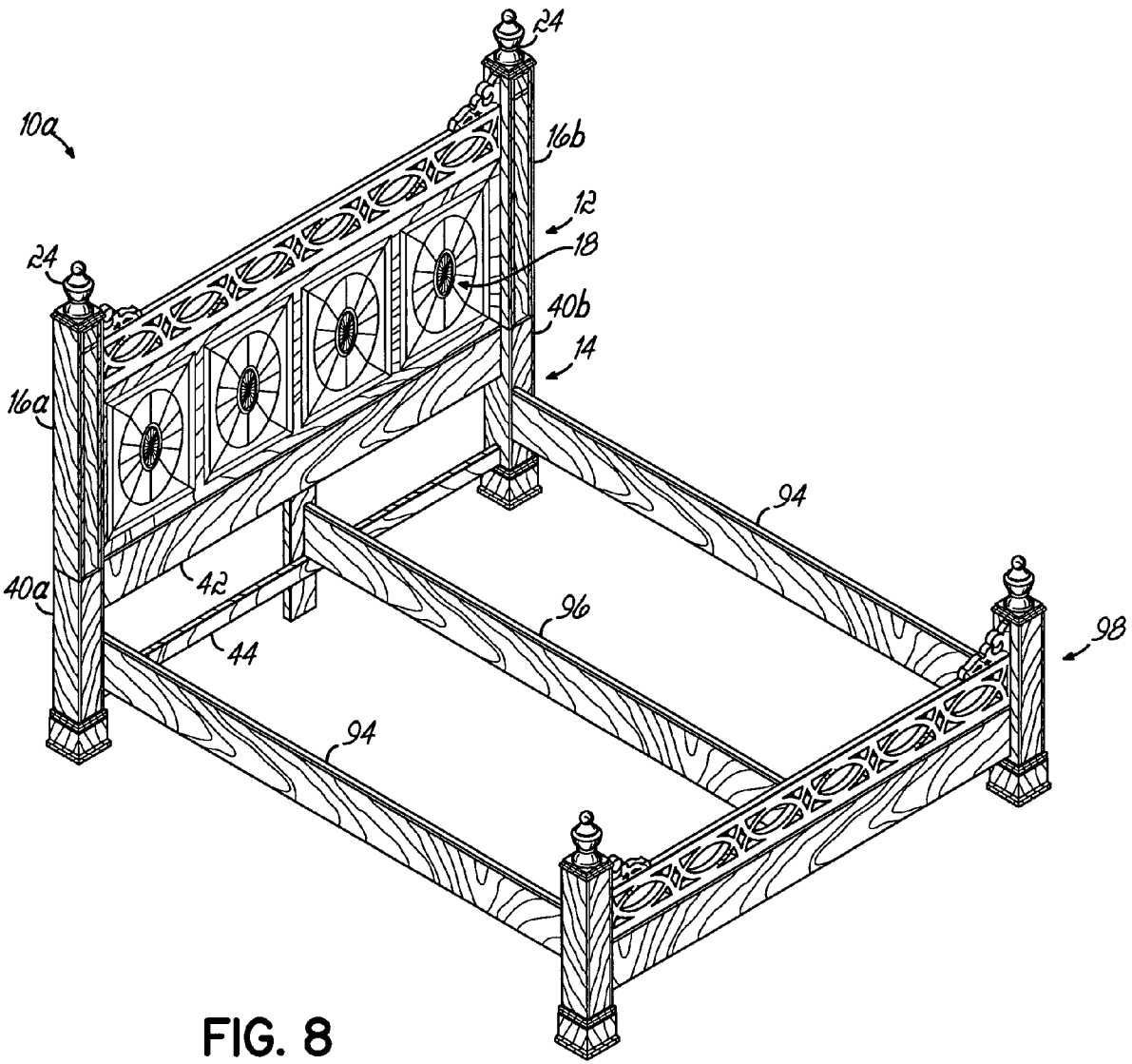
FIG. 8 is a perspective view of an exemplary bedstead including the modular headboard of the present invention.

In each embodiment, the center post 80 and the lower post sections 40*a*, 40*b* further include apertures 90 formed into forward facing surfaces 90, 92*a*, 92*b* thereof and sized to receive ends longitudinally-extending side rails 94 and center rails 96 for joining the modular headboard 10, 10*a* to a footboard 98 and thereby form a bedstead, as depicted in FIG. 8. The modular headboards 10, 10*a* are shown in the figures as being formed from wood or wood products, however, it will be recognized that the modular headboard could be formed from other materials, such as metal or plastic. Likewise, the side rails 94, 96 and footboard 98 may be formed from wood, metal, plastic, or other materials.

In accordance with the present invention, a method of assembling the modular headboard 10, 10*a*, including upper and lower headboard sections 12, 14 and a lapped slat 30 extending from a lower edge 32 of the upper headboard section 12, includes positioning the upper headboard section 12 on top of the lower headboard section 14, aligning the lapped slat 30 to overlie an upper edge 60 of the lower headboard section 14, and securing the lapped slat 30 to the lower headboard section 14. The method may further include installing dowel pins 58 into apertures 54*a*, 54*b* formed in one of the upper and lower headboard sections 12, 14, aligning corresponding apertures on the other of the upper and lower headboard sections 12, 14 with the dowel pins 58, and subsequently engaging the apertures on the other of the upper and lower headboard sections 12, 14 with the dowel pins 58 to join the upper and lower headboard sections 12, 14. The method may further include positioning a brace plate 70 to overlie adjacent edges of the upper and lower headboard sections 12, 14, securing the brace plate 70 to the respective portions of the upper and lower headboard sections 12, 14, and securing a center post 80 on the lower headboard section 14 to the slat 30 of the upper headboard section 12.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A modular headboard, comprising:

an upper headboard section, including first and second laterally-spaced, vertically-extending upper post sections and a headboard panel extending therebetween and having an outer side surface with a lower edge, said first and second upper post sections having upper and lower ends; and a lower headboard section, including first and second laterally-spaced, vertically-extending lower post sections and at least one cross member extending therebetween, said cross member having an outer side surface with an upper edge disposed adjacent said lower edge of said headboard panel, said first and second lower post sections having upper and lower ends;

said upper and lower headboard sections removably interconnected by a connection system comprising a laterally-extending slat having an outer side surface, said outer side surface of said slat contacting said outer side surface of said headboard panel and overlapping said lower edge of said outer side surface of said headboard panel, said outer side surface of said slat contacting said outer side surface of said cross member and overlapping said upper edge of said outer side surface of said cross member.

2. The modular headboard of claim 1, wherein said connection system further comprises:

first and second brace plates respectively fastened between said upper ends of said lower post sections and said lower ends of said upper post sections.

3. The modular headboard of claim 1, further comprising:

an aperture formed in each said lower end of said upper post sections;

an aperture formed in each said upper end of said lower post sections, said apertures in said lower post sections aligned with said apertures in said upper post sections; and a dowel pin extending between each of said upper and lower post sections and disposed in said respectively aligned apertures.

4. The modular headboard of claim 1, wherein said at least one cross member comprises at least two cross members, including an upper cross member and a lower cross member, the modular headboard further comprising:

a vertically-extending center post coupled to said upper and lower cross members and to said laterally-extending slat, said center post having an upper end including a flange extending upwardly therefrom and overlying said slat.

5. The modular headboard of claim 1, wherein said slat is adhesively secured to said lower edge of said upper headboard section, and secured to said upper edge of said at least one cross member by fasteners.

6. A bedstead, comprising:

a modular headboard, said modular headboard comprising:

an upper headboard section, including first and second laterally-spaced, vertically-extending upper post sections and a headboard panel extending therebetween and having an outer side surface with a lower edge, said first and second upper post sections having upper and lower ends; and a lower headboard section, including first and second laterally-spaced, vertically-extending lower post sections and at least one cross member extending therebetween, said cross member having an outer side surface with an upper edge disposed adjacent said lower edge of said headboard panel, said first and second lower post sections having upper and lower ends;

said upper and lower headboard sections removably interconnected by a connection system comprising a laterally-extending slat having an outer side surface, said outer side surface of said slat contacting said outer side surface of said headboard panel and overlapping said lower edge of said outer side surface of said headboard panel, said outer side surface of said slat contacting said outer side surface of said cross member and overlapping said upper edge of said outer side surface of said cross member;

a footboard spaced from said modular headboard; and first and second side rails having first ends coupled to said lower post sections, respectively, and second ends coupled to said footboard.

7. A method of assembling a modular headboard including upper and lower headboard sections, the method comprising:

positioning the upper headboard section on top of the lower headboard section;

aligning a lapped slat that extends from one of a lower edge of the upper headboard section, or an upper edge of the lower headboard section, to overlie the other of the upper and lower headboard sections such that an outer side surface of the slat contacts and overlaps the lower edge of an outer side surface of the upper headboard section and the upper edge of an outer side surface of the lower headboard section; and securing the lapped slat to the other of the upper and lower headboard sections.

8. The method of claim 7, wherein the lapped slat extends from the lower edge of the upper headboard section and wherein securing the lapped slat includes securing the lapped slat to the upper edge of the lower headboard section.

9. The method of claim 7, wherein the lapped slat extends from the upper edge of the lower headboard section and wherein securing the lapped slat includes securing the lapped slat to the lower edge of the upper headboard section.

10. The method of claim 7, wherein the upper and lower headboard sections include corresponding apertures formed in respective confronting surfaces, the method further comprising:

installing dowel pins in the apertures formed in one of the upper and lower headboard sections;

aligning the apertures on the other of the upper and lower headboard sections with the dowel pins; and engaging the apertures on the other of the upper and lower headboard sections with the dowel pins.

11. The method of claim 7, further comprising:

positioning a bracket to overlie adjacent edges of the upper and lower headboard sections; and securing the bracket to respective portions of the upper and lower headboard sections.

12. The method of claim 7, further comprising:

securing the lower headboard section to the upper headboard section by fastening a center post of the lower headboard section to the slat.

* * * * *